US008847839B2

(12) United States Patent
Nakamura et al.

(10) Patent No.: US 8,847,839 B2
(45) Date of Patent: Sep. 30, 2014

(54) RESONANCE-TYPE, RECEIVING ANTENNA AND RECEIVING APPARATUS

(75) Inventors: Masaki Nakamura, Tottori (JP); Hirokazu Araki, Saitama (JP); Masahiro Mita, Gunma (JP)

(73) Assignee: Hitachi Metals, Ltd., Tokyo (JP)

( * ) Notice: Subject to any disclaimer, the term of this patent is extended or adjusted under 35 U.S.C. 154(b) by 584 days.

(21) Appl. No.: 13/140,727

(22) PCT Filed: Dec. 11, 2009

(86) PCT No.: PCT/JP2009/070777
§ 371 (c)(1),
(2), (4) Date: Aug. 19, 2011

(87) PCT Pub. No.: WO2010/071087
PCT Pub. Date: Jun. 24, 2010

(65) Prior Publication Data

US 2012/0086619 A1 Apr. 12, 2012

(30) Foreign Application Priority Data

Dec. 19, 2008 (JP) ..... 2008-323826
Mar. 30, 2009 (JP) ..... 2009-081365

(51) Int. Cl.

| | |
|---|---|
| ***H01Q 7/08*** | (2006.01) |
| ***H01Q 1/27*** | (2006.01) |
| ***G04R 60/10*** | (2013.01) |
| ***G04G 21/04*** | (2013.01) |
| ***H01Q 7/06*** | (2006.01) |
| ***H01Q 1/24*** | (2006.01) |

(52) U.S. Cl.
CPC ..... *H01Q 7/06* (2013.01); *H01Q 1/273* (2013.01); *H01Q 7/08* (2013.01); *G04R 60/10* (2013.01); *G04G 21/04* (2013.01); *H01Q 1/242* (2013.01); *H01Q 1/243* (2013.01)
USPC ..... 343/788; 343/713

(58) Field of Classification Search
USPC ..... 343/788, 713, 787, 820, 843, 850
See application file for complete search history.

(56) References Cited

U.S. PATENT DOCUMENTS 4,290,070 A 9/1981 Tanaka et al.
4,620,155 A * 10/1986 Edelstein ..... 324/322

(Continued)

FOREIGN PATENT DOCUMENTS

DE 198 54 160 A1 6/2000
EP 1 122 814 A2 8/2001

(Continued)

OTHER PUBLICATIONS

Supplementary European Search Report issued in EP Application No. 09833390.9 dated Jan. 30, 2013.

(Continued)

*Primary Examiner* — Thien M Le
(74) *Attorney, Agent, or Firm* — Sughrue Mion, PLLC

(57) ABSTRACT

A resonance-type, receiving antenna comprising a circular-ring-shaped, magnetic core constituting a closed magnetic path having one gap, one or more coils wound around the circular-ring-shaped, magnetic core, and a capacitor connected in parallel to both ends of each coil; an angle between a straight line extending from a geographical center of the circular-ring-shaped, magnetic core to a center of the gap and a straight line extending from the geographical center to a center of the coil being in a range of 10° to 90°.

17 Claims, 12 Drawing Sheets

(56) References Cited

U.S. PATENT DOCUMENTS

| | | | | |
|---|---|---|---|---|
| 5,166,619 | A * | 11/1992 | Ries | 324/318 |
| 2003/0090434 | A1 | 5/2003 | Masudaya | |
| 2003/0122725 | A1* | 7/2003 | Ieda et al. | 343/788 |
| 2006/0214866 | A1 | 9/2006 | Araki et al. | |
| 2013/0119991 | A1* | 5/2013 | Soutome et al. | 324/322 |
| 2013/0201071 | A1* | 8/2013 | Uchida | 343/820 |

FOREIGN PATENT DOCUMENTS

| | | | |
|---|---|---|---|
| EP | 1 689 029 | A1 | 8/2006 |
| GB | 1 239 303 | A | 7/1971 |
| JP | 38-6805 | B1 | 5/1963 |
| JP | 56-18451 | A | 2/1981 |
| JP | 57-131042 | U | 8/1982 |
| JP | 2000-105285 | A | 4/2000 |
| JP | 2000-312110 | A | 11/2000 |
| JP | 2001-320223 | A | 11/2001 |
| JP | 2002-217635 | A | 8/2002 |
| JP | 2003-152442 | A | 5/2003 |
| JP | 2004-229144 | A | 8/2004 |
| JP | 2005-102023 | A | 4/2005 |
| JP | 2006-50522 | A | 2/2006 |

OTHER PUBLICATIONS

Communication dated Dec. 17, 2013, issued by the Japanese Patent Office in corresponding Application No. 2010-542952.

* cited by examiner

RESONANCE-TYPE, RECEIVING ANTENNA AND RECEIVING APPARATUS

CROSS REFERENCE TO RELATED APPLICATIONS

This application is a National Stage of International Application No. PCT/JP2009/070777, filed on Dec. 11, 2009, which claims priority from Japanese Patent Application No. 2008-323826, filed on Dec. 19, 2008 and Japanese Patent Application No. 2009-081365, filed on Mar. 30, 2009, the contents of all of which are incorporated herein by reference in their entirety.

FIELD OF THE INVENTION

The present invention relates to a resonance-type, receiving antenna and receiving apparatus suitable for radiowave watches, keyless entry systems, RFID tag systems, etc.

BACKGROUND OF THE INVENTION

Radiowave watches have a function to correct time by receiving magnetic field components of electromagnetic waves containing time information. Keyless entry systems enable owners of units transmitting and receiving particular electromagnetic waves to open and close keys of cars, houses, etc. without contact. RFID (radio frequency identification) systems send and receive information to and from tags with particular electromagnetic waves. For example, when RFID tags having destination information, etc. of buses, etc. are attached to buses, and when RFID tags having timetable information are embedded in timetable boards of bus stops, etc., users can recognize various types of transportation information without contact.

The keyless entry systems, etc. use radiowaves having frequencies of 40-200 kHz (several kilometers of wavelength). For example, two types of radiowaves of 40 kHz and 60 kHz are used in Japan, and mainly frequencies of 100 kHz or less are used overseas. For systems receiving electric field components of such long-wavelength radiowaves, antennas over several hundreds of meters are needed, not suitable for small radiowave wristwatches, small keyless entry systems and small RFID systems. Accordingly, it is preferable to use systems for receiving magnetic field components of long-wavelength radiowaves with magnetic sensor-type antennas comprising coils wound around magnetic cores.

As shown in the equivalent circuit of FIG. 14, when a magnetic field component of an electromagnetic wave input to an antenna flows through a magnetic core, voltage V induced in a coil L wound around the magnetic core resonates by a parallel resonance circuit of a coil L and a capacitor C, so that resonance current flows in the coil L at voltage Q times, wherein Q is a characteristic value of the resonance circuit. Because the antenna is disposed mostly in a metal casing, magnetic flux from the magnetic core ends flows through an adjacent metal casing, losing magnetic energy as eddy current loss. Accordingly, antennas used in radiowave wristwatches, etc. should be small, and there should be little magnetic flux leakage to reduce the eddy current loss.

In addition, receiving antennas for wristwatches, keyless entry systems, RFID systems, etc., whose magnetic core directions are changing every moment, are required to be omnidirectional, namely to have high receiving sensitivity in any directions of XYZ axes. As a technology for being omnidirectional, for example, JP 2002-217635 A discloses an antenna apparatus comprising coils perpendicularly wound around pluralities of rod-shaped, magnetic cores and connected in series. JP 2004-229144 A discloses a surface-mounted antenna comprising coils wound around pluralities of cross-shaped, magnetic cores projecting from a center base member. However, because of pluralities of rod-shaped, magnetic cores, these antennas are not suitable for small radiowave wristwatches, etc. with little space for antennas.

JP 2001-320223 A discloses a radiowave watch comprising an omnidirectional antenna comprising pluralities of coils wound around an integral, planar, ring-shaped, magnetic core in different directions. However, winding coils around the integral, ring-shaped, magnetic core needs time-consuming work.

JP 2000-105285 A discloses a portable radiowave watch comprising a housing, a watch module disposed at a center of the housing, an external operation means for the module, a groove surrounding the module in the housing, and an antenna received in the groove. The antenna is constituted by a C-type magnetic core and a coil wound around the magnetic core. However, the antenna of this structure has strong directivity.

JP 2005-102023 A discloses a receiving antenna structure disposed in a metal casing, which comprises a main magnetic path member comprising coils wound around a magnetic core, a sub-magnetic path member comprising a coil-free magnetic core, and a gap in a closed magnetic path along the magnetic core, thereby preventing magnetic flux from leaking outside during resonance. However, this antenna also has strong directivity.

OBJECTS OF THE INVENTION

Accordingly, an object of the present invention is to provide a small, omnidirectional, resonance-type, receiving antenna suitable for being arranged in narrow space in radiowave wristwatches, keyless entry systems, RFID systems, etc.

Another object of the present invention is to provide a receiving apparatus comprising such a resonance-type, receiving antenna.

DISCLOSURE OF THE INVENTION

The first resonance-type, receiving antenna of the present invention comprises a circular-ring-shaped, magnetic core constituting a closed magnetic path having one gap, a coil wound around the circular-ring-shaped, magnetic core, and a capacitor connected in parallel to both ends of the coil; an angle between a straight line extending from a geographical center of the circular-ring-shaped, magnetic core to a center of the gap and a straight line extending from the geographical center to a center of the coil being in a range of 10° to 90°.

The second resonance-type, receiving antenna of the present invention comprises a circular-ring-shaped, magnetic core constituting a closed magnetic path having one gap, two coils wound around the circular-ring-shaped, magnetic core, and a capacitor connected in parallel to both ends of each coil; an angle between a straight line extending from a geographical center of the circular-ring-shaped, magnetic core to a center of the gap and a straight line extending from the geographical center to a center of each coil being in a range of 10° to 90°.

In the first and second resonance-type, receiving antennas, the circular-ring-shaped, magnetic core preferably has a ratio of the longest diameter to the shortest diameter in a range of 1-2.

The third resonance-type, receiving antenna of the present invention comprises a rectangular-ring-shaped, magnetic core constituting a closed magnetic path having one gap, two coils wound around the rectangular-ring-shaped, magnetic core, and a capacitor connected in parallel to both ends of each coil; the axial directions of the two coils being perpendicular to each other; and the distances between the coils and the gap being different.

The fourth resonance-type, receiving antenna of the present invention comprises a circular-ring-shaped, magnetic core constituting a closed magnetic path having two or three gaps, two coils wound around the circular-ring-shaped, magnetic core, and a capacitor connected in parallel to both ends of each coil; an angle between a straight line extending from a geographical center of the circular-ring-shaped, magnetic core to a center of one gap and a straight line extending from the geographical center to a center of each coil being in a range of 10° to 90°.

The fifth resonance-type, receiving antenna of the present invention comprises a rectangular-ring-shaped, magnetic core comprising a closed magnetic path having two or three gaps, two coils wound around the rectangular-ring-shaped, magnetic core, and a capacitor connected in parallel to both ends of each coil; the axial directions of the two coils being perpendicular to each other.

To detect a magnetic flux generated in a Z-axis direction from the magnetic core of the resonance-type, receiving antenna of the present invention, a coreless coil or a coil wound around a ferrite core may be disposed as an additional coil.

In any of the above resonance-type, receiving antennas, the magnetic core is preferably obtained by laminating ribbons of a soft-magnetic, amorphous or nano-crystalline alloy, or by bundling thin wires of a soft-magnetic, amorphous or nano-crystalline alloy.

The receiving apparatus of the present invention comprises the above resonance-type, receiving antenna, and circuit devices disposed inside the resonance-type, receiving antenna.

BRIEF DESCRIPTION OF THE DRAWINGS

FIG. 4(*b*) is a schematic view showing a resonance-type, receiving antenna according to a still further embodiment of the present invention.

FIG. 4(*c*) is a schematic view showing a resonance-type, receiving antenna according to a still further embodiment of the present invention.

FIG. 8(*b*) is a schematic view showing a resonance-type, receiving antenna according to a still further embodiment of the present invention.

FIG. 8(*c*) is a schematic view showing a resonance-type, receiving antenna according to a still further embodiment of the present invention.

FIG. 10(*b*) is a schematic view showing a resonance-type, receiving antenna according to a still further embodiment of the present invention.

FIG. 10(*c*) is a schematic view showing a resonance-type, receiving antenna according to a still further embodiment of the present invention.

FIG. 12(*b*) is a schematic view showing another example of radiowave wristwatches comprising the resonance-type, receiving antenna of the present invention.

FIG. 13(*b*) is a schematic view showing another example of RFID systems comprising the resonance-type, receiving antenna of the present invention.

DESCRIPTION OF THE BEST MODE OF THE INVENTION

[1] Embodiments

Figure 1:
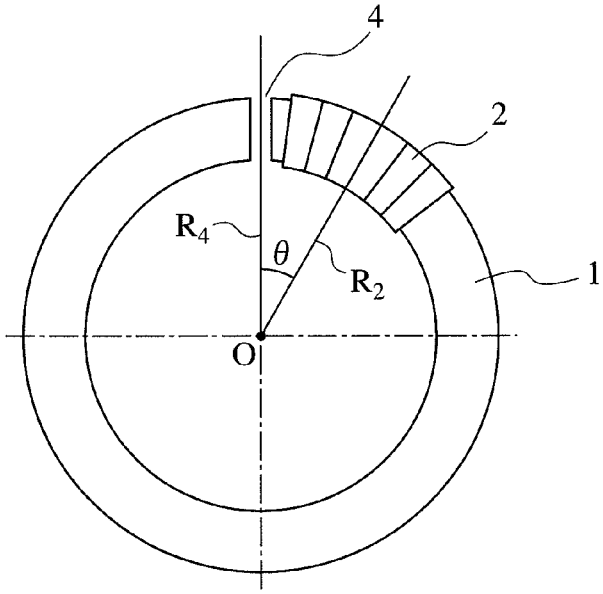
FIG. 1 is a schematic view showing a resonance-type, receiving antenna according to one embodiment of the present invention.

The first resonance-type, receiving antenna of the present invention comprises a circular-ring-shaped, magnetic core 1 constituting a closed magnetic path having one gap 4, a coil 2 wound around the circular-ring-shaped, magnetic core 1, and a capacitor connected in parallel to both ends of the coil 2; an angle θ between a straight line (outer diameter) $R_4$ extending from a geographical center O of the circular-ring-shaped, magnetic core 1 to a center of the gap 4 and a straight line (outer diameter) $R_2$ extending from the geographical center O to the center of the coil 2 being in a range of 10° to 90°.

The second resonance-type, receiving antenna of the present invention comprises a circular-ring-shaped, magnetic core 1 constituting a closed magnetic path having one gap 4, two coils 2*a*, 2*b* wound around the circular-ring-shaped, magnetic core 1, and a capacitor connected in parallel to both ends of each coil 2*a*, 2*b*; angles $\theta_a$, $\theta_b$ between a straight line (outer diameter) $R_4$ extending from a geographical center O of the circular-ring-shaped, magnetic core 1 to a center of the gap 4 and straight lines (outer diameters) $R_{2a}$, $R_{2b}$ extending from the geographical center O to the centers of the coils 2*a*, 2*b* being respectively in a range of 10° to 90°.

In the first and second resonance-type, receiving antennas, a Dmax/Dmin ratio of the longest diameter Dmax to the shortest diameter Dmin of the circular-ring-shaped, magnetic core 1 is preferably in a range of 1-2.

The third resonance-type, receiving antenna of the present invention comprises a rectangular-ring-shaped, magnetic core 1 constituting a closed magnetic path having one gap 4, two coils 2*a*, 2*b* wound around the rectangular-ring-shaped, magnetic core 1, and a capacitor connected in parallel to both ends of each coil 2*a*, 2*b*; the axial directions of the two coils 2*a*, 2*b* being perpendicular to each other; and distances between the coils 2*a*, 2*b* and the gap 4 being different.

The fourth resonance-type, receiving antenna of the present invention comprises a circular-ring-shaped, magnetic core 1 constituting a closed magnetic path having two or three gaps 4*a*, 4*b*, two coils 2*a*, 2*b* wound around the circular-ring-shaped, magnetic core 1, and a capacitor connected in parallel to both ends of each coil 2*a*, 2*b*; an angle $\theta_a$, $\theta_b$ between a straight line (outer diameter) $R_4$ extending from a geographical center O of the circular-ring-shaped, magnetic core to a center of the gap 4 and a straight line (outer diameter) $R_{2a}$, $R_{2b}$ extending from the geographical center O to a center of each coil 2*a*, 2*b* being in a range of 10° to 90°.

The fifth resonance-type, receiving antenna of the present invention comprises a rectangular-ring-shaped, magnetic core 1 constituting a closed magnetic path having two or three gaps 4*a*, 4*b* (4*c*), two coils 2*a*, 2*b* wound around the rectangular-ring-shaped, magnetic core 1, and a capacitor connected in parallel to both ends of each coil 2*a*, 2*b*; the axial directions of the two coils 2*a*, 2*b* being perpendicular to each other.

The receiving apparatus of the present invention comprises any one of the above resonance-type, receiving antennas, and circuit devices arranged inside the resonance-type, receiving antenna.

[2] Resonance-Type, Receiving Antenna (1) Magnetic Core

The receiving antenna of the present invention comprises a ring-shaped, magnetic core having a gap or gaps. The term "circular-ring-shaped" used with respect to the shape of the magnetic core is not restricted to a true circle, but includes a deformed circle (for example, an egg shape, an ellipsoid, and an elongated circle) as long as it does not have corners. The term "rectangular-ring-shaped" generally means an outer shape of a square or a rectangle, but its corners need not be 90°, but may be properly rounded.

Figure 10A:
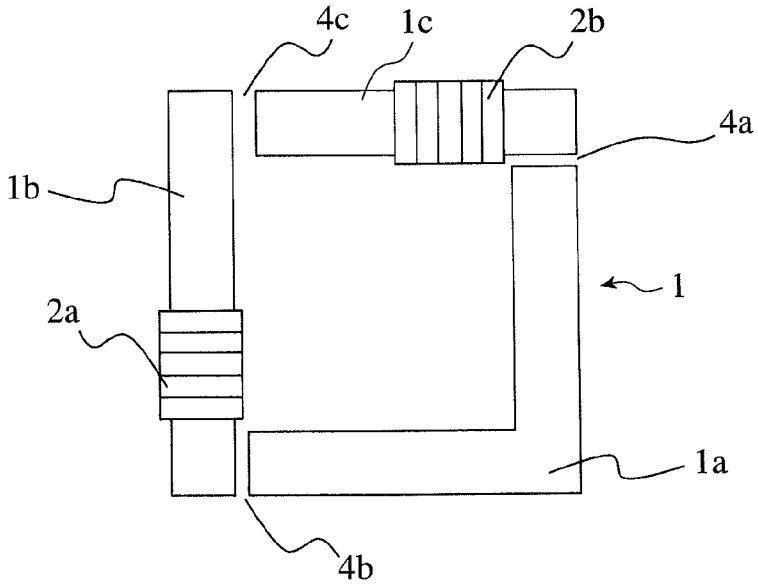
FIG. 10(*a*) is a schematic view showing a resonance-type, receiving antenna according to a still further embodiment of the present invention.
Figure 10B:
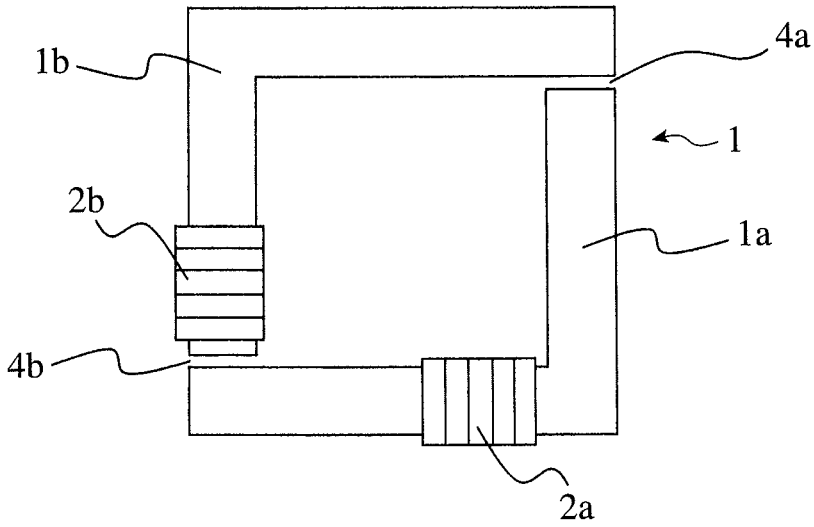
Figure 10C:
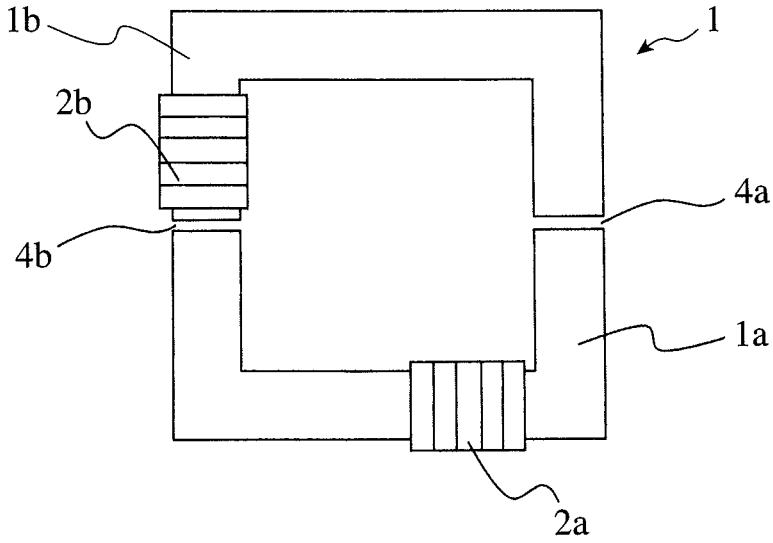

The magnetic core may be a combination of a C-type magnetic core, an I-type magnetic core, a U-type magnetic core, etc. Although the optimum gap width may differ depending on the permeability and required characteristics of a magnetic material used for the magnetic core, a smaller gap width is better when high-permeability, amorphous alloy ribbons, etc. are used. Specifically, the gap width is preferably in a range of 0.1-3 mm. The gap may be disposed in any portion of the magnetic core, and a gap 4*a* may be formed, for instance, by disposing an end surface of one magnetic core piece 1*a* close to a side surface of another magnetic core piece 1*c* as shown in FIG. 10(*a*). The gap may be space, or filled with non-magnetic materials such as resins, etc.

In the case of the circular-ring-shaped, magnetic core, a ratio of Dmax/Dmin, wherein Dmax is the longest diameter, and Dmin is the shortest diameter, is preferably in a range of 1-2. The circular-ring-shaped, magnetic core with Dmax/Dmin near 1 detects high voltage. When the Dmax/Dmin is more than 2, the detected voltage is extremely low, failing to obtain sufficient detection sensitivity. The Dmax/Dmin is more preferably 1-1.6.

The magnetic core can be formed by soft-magnetic ferrite, amorphous alloys, nano-crystalline alloys, etc., and are preferably obtained by laminating ribbons of soft-magnetic, amorphous alloys or nano-crystalline alloys, or by bundling thin wires of soft-magnetic, amorphous alloys or nano-crystalline alloys. Particularly amorphous alloys have such a wide resilient deformation range that a gap of their magnetic core can be expanded to insert a coil, and that their magnetic core can be easily arranged along an inner wall of the casing. Further, because the amorphous alloys have excellent impact resistance, they are not broken by impact by dropping, etc., suitable for mobile gears such as radiowave wristwatches, keyless entry systems, etc.

The preferred composition of the amorphous alloy is represented by the general formula of $(Fe_{1-a}T_a)_{bal}Si_xB_yM_z$, wherein T is Co and/or Ni, M is at least one element selected from the group consisting of V, Mn, Nb, Ta, Cr, Mo and W, and a, x, y and z are atomic %, meeting the conditions of $1 \le a \le 0$, $1 \le x \le 18$, $5 \le y \le 17$, $0 \le z \le 5$, and $17 \le x+y+z \le 25$.

Silicon Si makes the amorphous alloy less brittle, so that amorphous alloy ribbons can be easily produced. To obtain this effect, Si is preferably 1 atomic % or more. To improve the soft magnetic properties (particularly to decrease the residual magnetic flux density), Si is preferably 18 atomic % or less. 5 atomic % or more of boron B is effective to form amorphous alloys. To obtain the preferred soft magnetic properties, B is preferably 17 atomic % or less.

Cobalt (Co) and nickel (Ni) are effective to improve the saturation magnetic flux density, and particularly Co has excellent corrosion resistance. To obtain effective antenna characteristics with small space, Co- or Ni-based alloy compositions are preferable. Fe-based alloys need resin coatings, etc. for rust prevention.

(2) Coil

Though not restrictive, the number of coils wound around the magnetic core is preferably 1-2. When a circular-ring-shaped, magnetic core is provided with one or two coils, an angle θ between a straight line $R_4$ extending from a geographical center O of the circular-ring-shaped, magnetic core to a center of the gap 4 and a straight line $R_2$ extending from the geographical center O to a center of each coil 2 should be in a range of 10° to 90°. When the angle θ is less than 10°, the detection sensitivity remarkably decreases to an undesirable level. When the angle θ exceeds 90°, the directivity becomes undesirably strong. It has been found that although two perpendicular coils seems to provide the magneto-sensitive axis directions with 90° difference, the influence of the gap 4 makes an angle between the axial directions of two coils different from an angle between the magneto-sensitive axes.

Figure 4A:
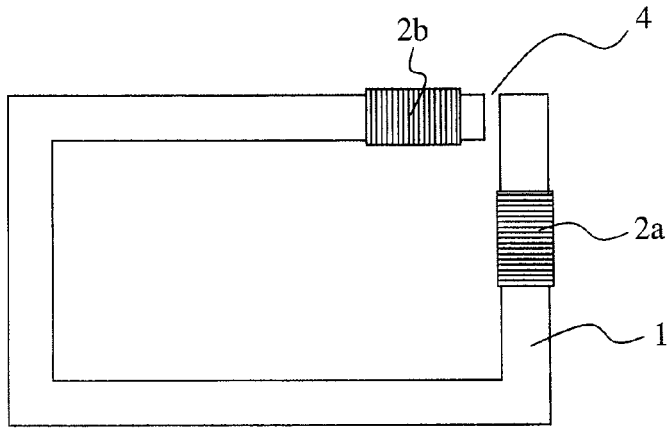
FIG. 4(*a*) is a schematic view showing a resonance-type, receiving antenna according to a further embodiment of the present invention.
Figure 4B:
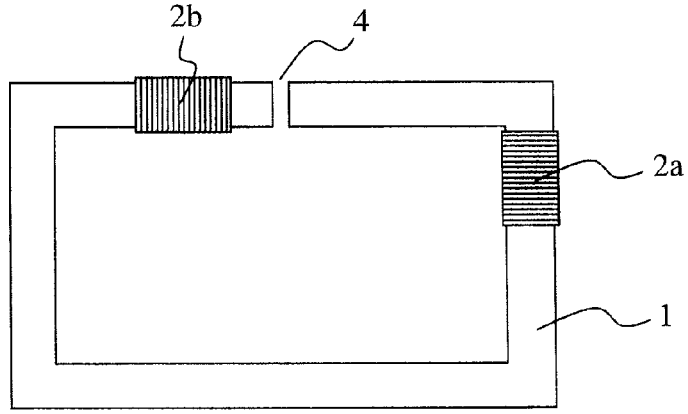
Figure 4C:
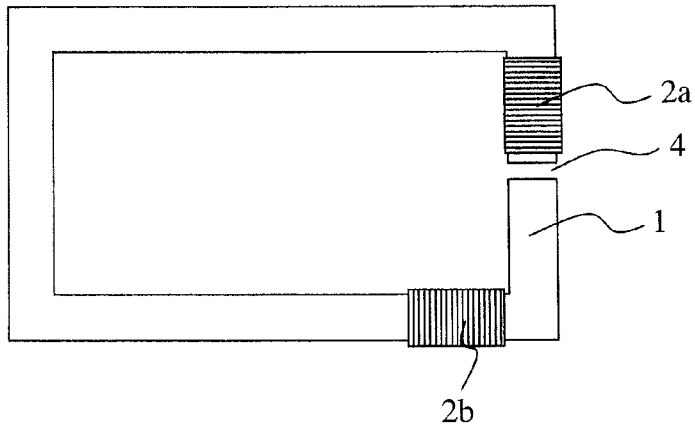

As shown in FIGS. 4(*a*)-4(*c*), when a rectangular-ring-shaped, magnetic core is provided with two coils 2*a*, 2*b*, the axial directions of the two coils 2*a*, 2*b* should be perpendicular to each other. Also, different distances between the coils 2*a*, 2*b* and the gap 4 provide low symmetry, preferably making the antenna omnidirectional.

[3] Additional Coil

The receiving antenna of the present invention preferably comprises an additional coil (Z-axis coil) in parallel to the ring-shaped, magnetic core 1, to detect a magnetic flux in the Z-axis direction (axial direction) of the ring-shaped, magnetic core 1. With the Z-axis coil, a magnetic flux in the Z-axis direction can be detected, in addition to magnetic fluxes in the X- and Y-axis directions which are detected by the coil 2 wound around the ring-shaped, magnetic core 1, resulting in high detection sensitivity in all directions. Because a larger area inside the Z-axis coil provides higher detection sensitivity in the Z-axis direction, the Z-axis coil is arranged preferably between an inner surface of the casing and an outer periphery of the circuit device. Though the Z-axis coil may be coreless, it may have a magnetic core. It is preferable to use a circuit capable of detecting voltages QV by the X-axis coil, the Y-axis coil and Z-axis coil and selecting the highest voltage.

[4] Receiving Apparatus

To be free from the influence of incoming radiowaves, the receiving apparatus of the present invention preferably comprises circuit devices (capacitors, batteries, resistors, etc.) arranged inside the magnetic core. This structure provides the receiving apparatus with higher detection sensitivity of radiowaves. In this case, the ring-shaped, magnetic core is preferably constituted by soft-magnetic ribbons or soft-magnetic, thin wires for miniaturization and higher impact resistance. In the case of a radiowave watch, for example, improved receiving sensitivity is obtained by arranging the circular-ring-shaped, magnetic core along an inner surface of the casing.

Because a capacitor is connected in parallel to a coil wound around the magnetic core in the receiving antenna of the present invention, magnetic flux generated by resonance current does not substantially penetrate the metal casing, resulting in less eddy current generated in the metal casing, and higher antenna sensitivity.

The present invention will be explained specifically referring to Examples below without intention of restriction.

Example 1 and Comparative Example 1

FIG. 1 schematically shows the first resonance-type, receiving antenna of the present invention. In this resonance-type, receiving antenna, an angle θ between a straight line $R_4$ extending from a geographical center O of the circular-ring-shaped, magnetic core 1 constituting a closed magnetic path having one gap 4 to a center of the gap 4 and a straight line $R_2$ extending from the geographical center O to the center of the coil 2 is 30°.

The circular-ring-shaped, magnetic core 1 was formed by laminating 10 ribbons of a Co-based, amorphous alloy (ACO5) having a width of 1 mm and a thickness of 22 μm, which was coated with a 2-μm-thick epoxy resin, winding the resultant laminate to have a gap 4 of 1 mm and a diameter of 40 mm, and integrally heat-curing the epoxy resin. The above Co-based, amorphous alloy is ACO5 available from Hitachi Metals, Ltd. A peripheral surface of the circular-ring-shaped, magnetic core 1 was supported by a bobbin (not shown). The coil 2 was formed by winding a 0.1-mm-thick magnet wire (enameled wire) to 1000 turns around a core of 1 mm in width and 250 μm in thickness, and removing the core. The coil 2 was connected in parallel to the capacitor 3 to constitute a resonance circuit.

Figure 7:
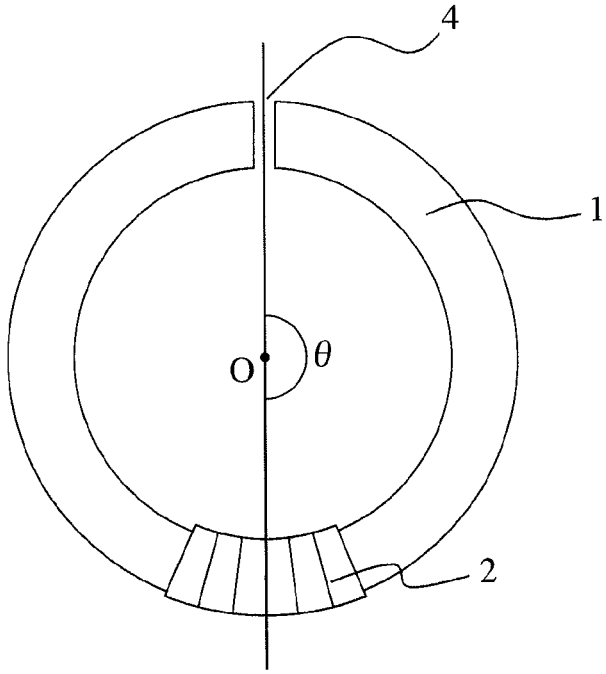
FIG. 7 is a schematic view showing a receiving antenna outside the scope of the present invention.

In Example 1, the gap 4 was resiliently expanded to insert the circular-ring-shaped, magnetic core 1 into the coil 2, and fixed by an epoxy adhesive at an angle θ of 30°. In Comparative Example 1, the angle θ between the coil 2 and the gap 4 was 180° as shown in FIG. 7.

Figure 2:
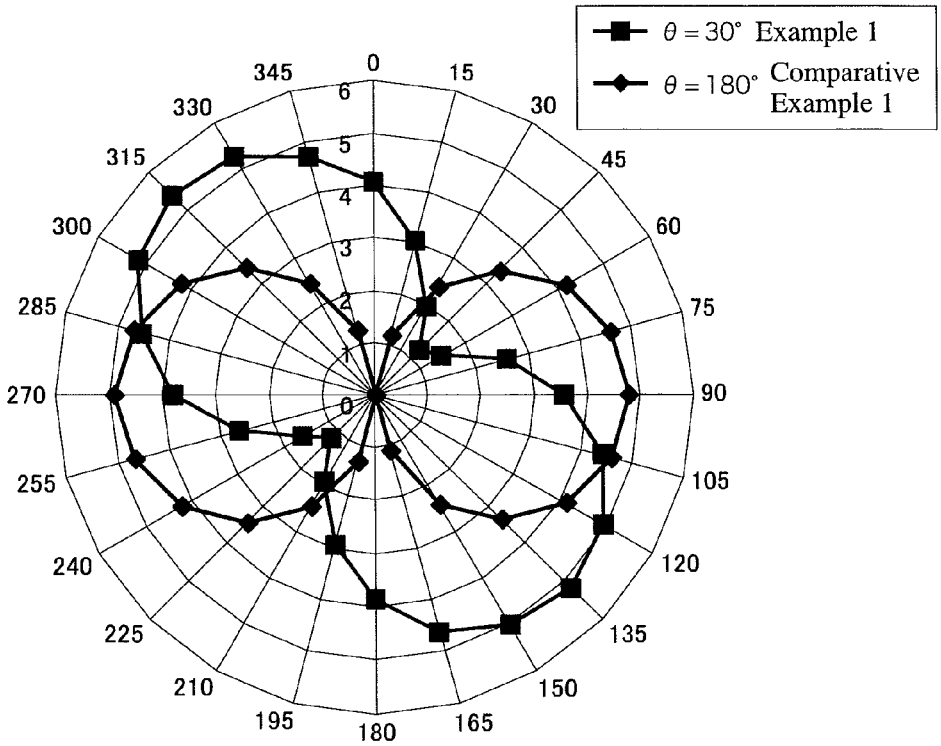
FIG. 2 is a polar graph showing the dependency of receiving sensitivity on a direction in an in an XY plane in the resonance-type, receiving antennas of Example 1 and Comparative Example 1.

With respect to the antennas of Example 1 (θ=30°) and Comparative Example 1 (θ=180°), the magnetic-flux-detecting sensitivity in all directions) (360° was measured in an XY plane, whose origin was the geographical center O of the circular-ring-shaped, magnetic core 1, and the results are shown in FIG. 2. The radial axis of the polar graph indicates voltage (mV) detected at both ends of the coil 2.

In the antenna of Comparative Example 1, the detection sensitivity of the coil 2 was about 5 mV, maximum, in axial directions (directions perpendicular to a radius of the circular-ring-shaped, magnetic core 1 passing the center of the coil 2, 90° and 270°), and substantially 0 mV, minimum, in directions (0° and 180°) perpendicular to the axial directions. Namely, the antenna clearly had directivity. In the antenna of Example 1, however, the detection sensitivity of the coil 2 was about 1.2 mV, minimum, in directions (45° and 225°) deviated by 15° from directions perpendicular to the axial directions, and about 5.2 mV, maximum, at angles (135° and 315°) deviated by 15° from the axial directions (120° and 300°). Thus, the voltage was at the maximum in directions deviated by 15° from the axial directions of the coil 2 in Example 1. A ratio (minimum voltage/maximum voltage) of the minimum voltage to the maximum voltage was 0% (0/5) in Comparative Example 1, and 23% (1.2/5.2×100) in Example 1.

Example 2 and Comparative Example 2

With respect to the same antenna as in Example 1 except for changing the angle θ of the coil 2, the magnetic-flux-detecting sensitivity was measured in all directions (360°) in an XY plane, whose origin was the geographical center θ of the circular-ring-shaped, magnetic core 1, to calculate the minimum voltage/the maximum voltage. The results are shown in Table 1. The (minimum voltage/maximum voltage) ratio exceeded 20% at an angle θ in a range of 10° to 90°, but as low as 12.3% or less outside this range.

TABLE 1

| θ (°) | 5 | 10 | 20 | 45 | 60 | 90 | 100 | 135 | 180 |
|---|---|---|---|---|---|---|---|---|---|
| Vmin/Vmax (%)(1) | 12.2 | 20.2 | 24.2 | 22.9 | 21.7 | 20.3 | 12.3 | 9.8 | 0.2 |

Note:
(1)Vmin means the minimum voltage, and Vmax means the maximum voltage.

Example 3

Figure 3:
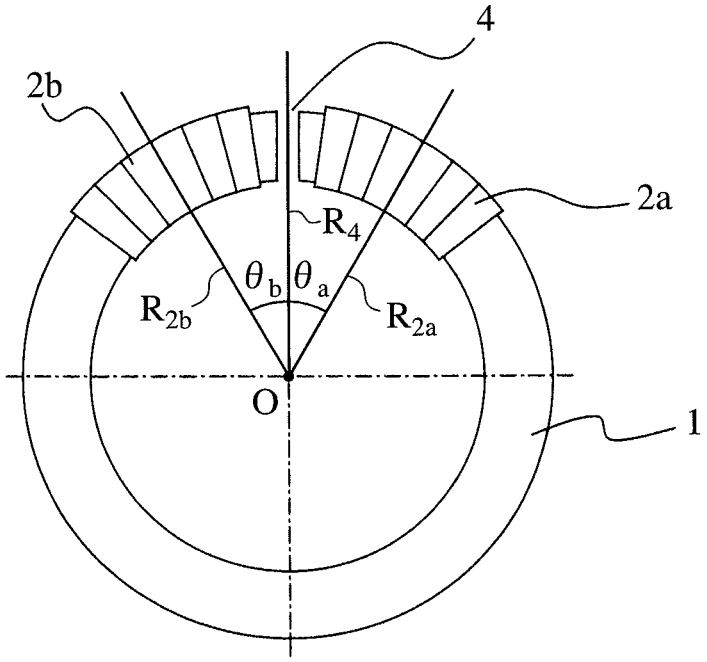
FIG. 3 is a schematic view showing a resonance-type, receiving antenna according to another embodiment of the present invention.

To increase detection sensitivity in directions perpendicular to the axial directions of the coil, a coil was added to the antenna of FIG. 1 to form an antenna shown in FIG. 3. Angles $\theta_a$, $\theta_b$ between a straight line $R_4$ extending from a geographical center O of the circular-ring-shaped, magnetic core 1 to a center of the gap 4 and straight lines $R_{2a}$, $R_{2b}$ extending from the geographical center O to the centers of two coils 2*a*, 2*b* were +30° and −30°, respectively. Accordingly, the axial directions of the coils 2*a*, 2*b* are +60° and −60°. A capacitor was connected in parallel to each coil 2*a*, 2*b*.

the magnetic-flux-detecting sensitivity was measured in all directions) (360° in an XY plane, whose origin was the geographical center O of the circular-ring-shaped, magnetic core 1. The detection sensitivity of the coil 2*a* with θ=+30° was at least about 1.3 mV in directions (45° and 225°) deviated by 15° from directions perpendicular to the axial directions, and about 5.4 mV at maximum at angles (135° and 315°) deviated by 15° from the axial directions (120° and 300°). The (minimum voltage/maximum voltage) ratio of the coil 2*a* was 24% (1.3/5.4×100).

The detection sensitivity of the coil 2*b* with θ=−30° was at least about 1.2 mV in directions (135° and 315°) deviated by 15° from directions perpendicular to the axial directions, and about 5.4 mV at maximum at angles (45° and 225°) deviated by 15° from the axial directions (60° and 240°). The (minimum voltage/maximum voltage) ratio of the coil 2*b* was 22% (1.2/5.4×100).

Example 4

The circular-ring-shaped, magnetic core 1 of Example 3 was deformed such that an outer diameter $R_4$ of the circular-ring-shaped, magnetic core 1 passing through a center of the gap 4 was the longest diameter Dmax, and that an outer diameter perpendicular to $R_4$ was the shortest diameter Dmin, to examine the change of antenna directivity with the Dmax/Dmin ratio. Although the detected maximum voltage was 90% or more of Example 2 at the Dmax/Dmin of 2 or less, it was reduced to 80% or less of Example 2 when the Dmax/Dmin exceeded 2. Oppositely, even when the circular-ring-shaped, magnetic core 1 was deformed with $R_4$ as Dmin, and an outer diameter perpendicular to $R_4$ as Dmax, the same tendency was appreciated. The same tendency was appreciated also in the circular-ring-shaped, magnetic core 1 of Example 1. Accordingly, the Dmax/Dmin ratio is preferably in a range of 1-2.

Example 5

FIGS. 4(*a*)-4(*c*) show an example of rectangular-ring-shaped, resonance-type, receiving antennas of the present invention. A rectangular-ring-shaped, magnetic core 1 was formed by punching a ribbon of 50 mm in width and 22 μm in thickness made of the same Co-based, amorphous alloy (ACO5) as in Example 1 to form 10 rectangular-ring-shaped ribbon pieces of 15 mm×30 mm×1.5 mm (width), laminating them with a 2-μm-thick epoxy resin coating on each ribbon piece, and heat-curing the epoxy resin. A gap 4 was 1 mm.

In any examples shown in FIGS. 4(*a*)-4(*c*), the rectangular-ring-shaped, magnetic core 1 was provided with two coils 2*a*, 2*b* perpendicular to each other. Two coils 2*a*, 2*b* were arranged on both sides of the gap 4 with different distances from the gap 4. Each coil 2*a*, 2*b* was produced by winding a 0.1 mm-thick magnet wire (enameled wire) by 1000 turns around a core of 2 mm in width and 300 μm in thickness, and removing the core. A capacitor was connected in parallel to each coil 2*a*, 2*b* to constitute a resonance circuit.

With respect to the rectangular-ring-shaped, resonance-type, receiving antennas shown in FIGS. 4(*a*)-4(*c*), the ratios of the minimum voltage to the maximum voltage (minimum voltage/maximum voltage) calculated in the same manner as in Example 3 were 22% (1.2/5.4×100), 24% (1.3/5.4×100), and 23% (1.2/5.3×100), respectively, for both coils 2*a*, 2*b* in the examples shown in FIGS. 4(*a*)-4(*c*). Thus, with two perpendicular coils 2*a*, 2*b*, high detection sensitivity was obtained in all directions in an XY plane.

Comparative Example 3

Figure 5:
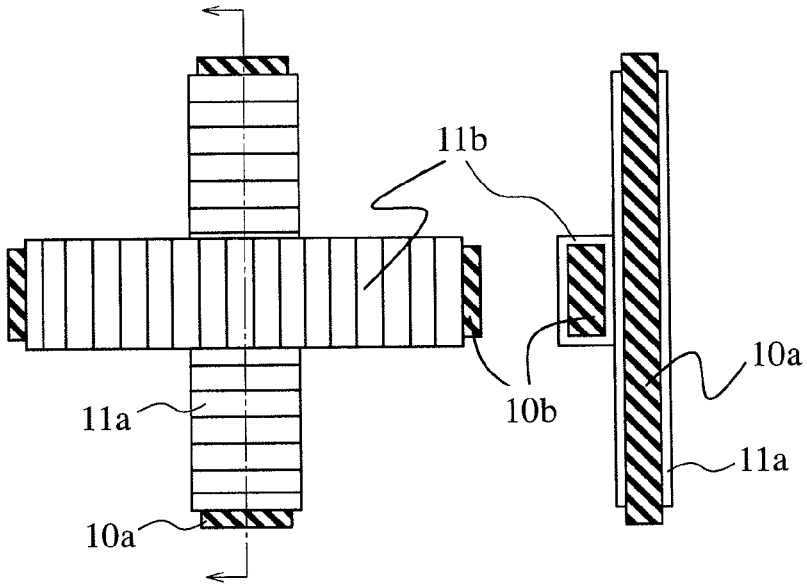
FIG. 5 is a schematic view showing a conventional receiving antenna.
Figure 6:
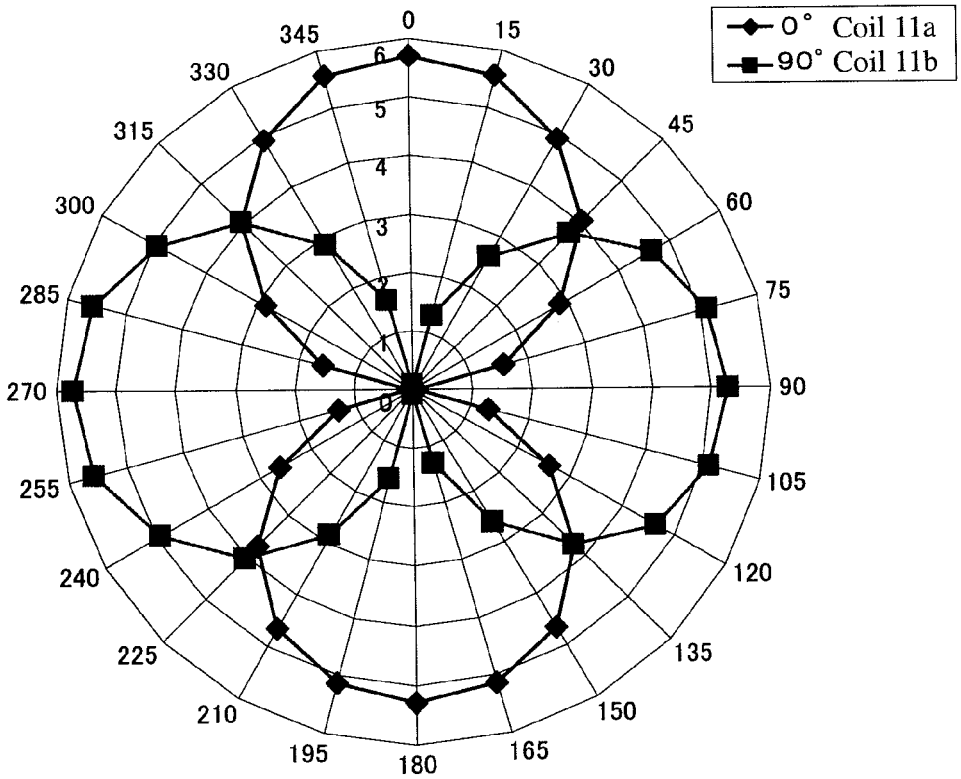
FIG. 6 is a polar graph showing the dependency of receiving sensitivity on a direction in an in an XY plane in the conventional receiving antenna of Comparative Example 3.

A conventional receiving antenna shown in FIG. 5 was produced with two rod antennas perpendicularly crossed. Each rod-shaped, magnetic core 10*a*, 10*b* was produced by laminating 17 ribbon pieces of a Co-based, amorphous alloy (ACO5) having a length of 10 mm, a width of 1 mm and a thickness of 22 μm with a 2-μm-thick epoxy resin coating, and heat-curing them. Each coil 11*a*, 11*b* was formed by winding a 0.1-mm-thick magnet wire (enameled wire) by 710 turns. The magnetic-flux-detecting sensitivity was measured in all directions (360°) in an XY plane with an intersection of both rod antennas 10*a*, 10*b* as the origin. The results are shown in FIG. 6. Because voltage detected by a rod antenna is substantially zero in directions perpendicular to the axial direction of the coil, two rod antennas should be arranged perpendicularly.

Example 6

Figure 8A:
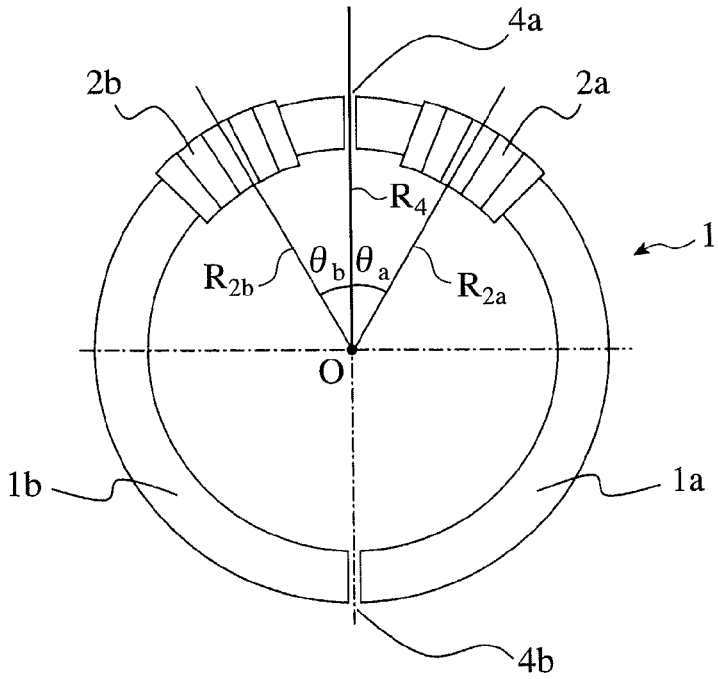
FIG. 8(*a*) is a schematic view showing a resonance-type, receiving antenna according to a still further embodiment of the present invention.
Figure 8B:
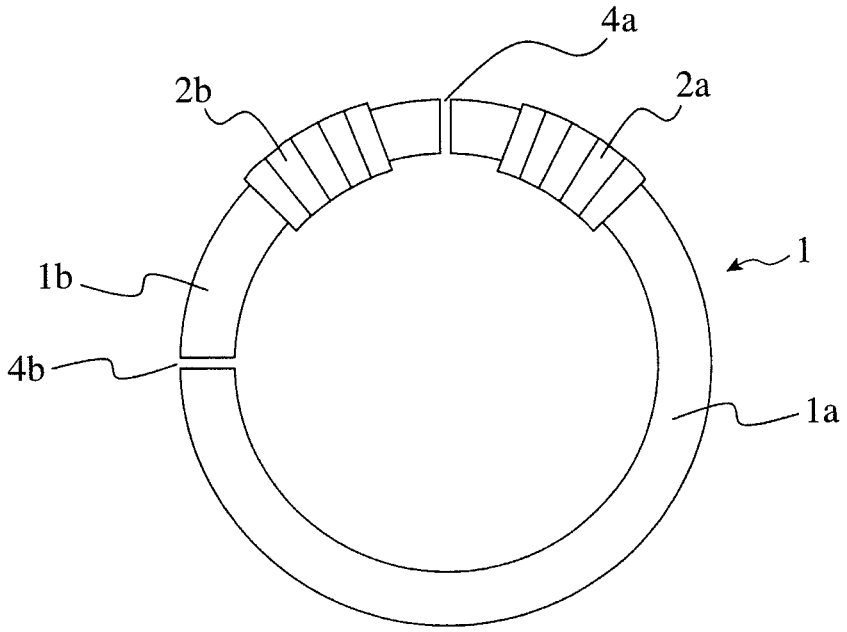
Figure 8C:
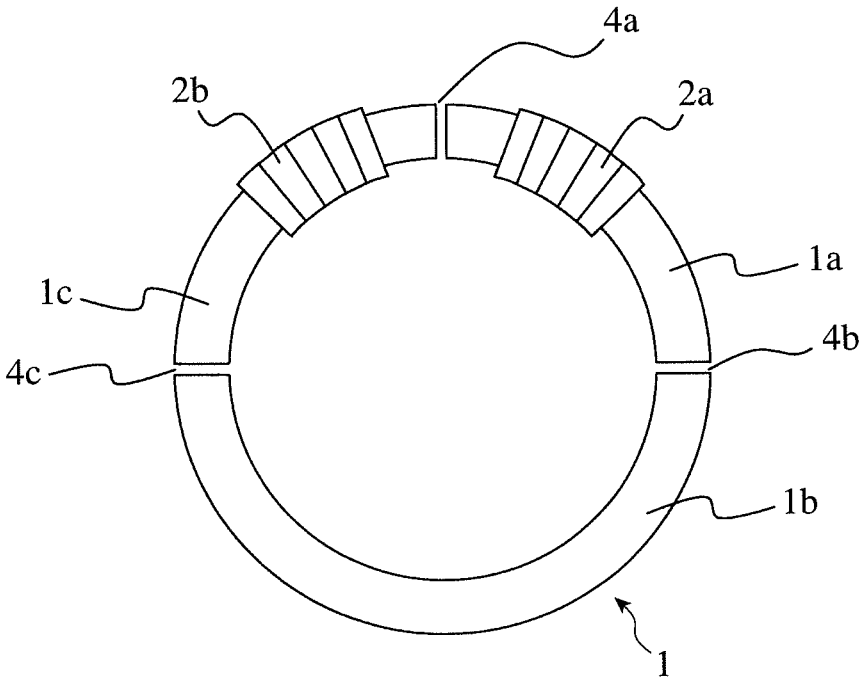

FIG. 8(*a*) shows another example of circular-ring-shaped, resonance-type, receiving antennas of the present invention. This circular-ring-shaped, resonance-type, receiving antenna comprises a circular-ring-shaped, magnetic core 1 constituted by arcuate magnetic core pieces 1*a*, 1*b* for forming a closed magnetic path with two gaps 4*a*, 4*b*, and two coils 2*a*, 2*b* each wound around each magnetic core piece 1*a*, 1*b*, angles $\theta_a$, $\theta_b$ between a straight line $R_4$ extending from a geographical center O of the circular-ring-shaped, magnetic core 1 to a center of one gap 4*a* and straight lines $R_{2a}$, $R_{2b}$ extending from the geographical center O to centers of two coils 2*a*, 2*b* being +30° and −30°, respectively. Accordingly, an angle $(\theta+\theta_b)$ of the centers of two coils 2*a*, 2*b* relative to the geographical center O is 60°. Also, two gaps 4*a*, 4*b* were 180° relative to the geographical center O. A capacitor was connected in parallel to each coil 2*a*, 2*b* to constitute a resonance circuit.

The circular-ring-shaped, magnetic core 1 was formed by laminating five ribbons of 1 mm in width and 14 μm in thickness made of a Co-based, amorphous alloy (ACO5) and each coated with an epoxy resin in a thickness of 2 μm, winding them to have a diameter of 40 mm, and then heat-curing them. Each gap 4*a*, 4*b* was 1 mm. A periphery of the circular-ring-shaped, magnetic core 1 was supported by a bobbin (not shown).

Each coil 2*a*, 2*b* was produced by winding a 0.1-mm-thick magnet wire (enameled wire) by 1000 turns around a core of 2 mm in width and 1.5 mm in thickness, and removing the core. Each magnetic core piece 1*a*, 1*b* was inserted into each coil 2*a*, 2*b*, and fixed with an epoxy adhesive at such a position that the angles $\theta_a$, $\theta_b$ were +30° and −30°, respectively.

Figure 9:
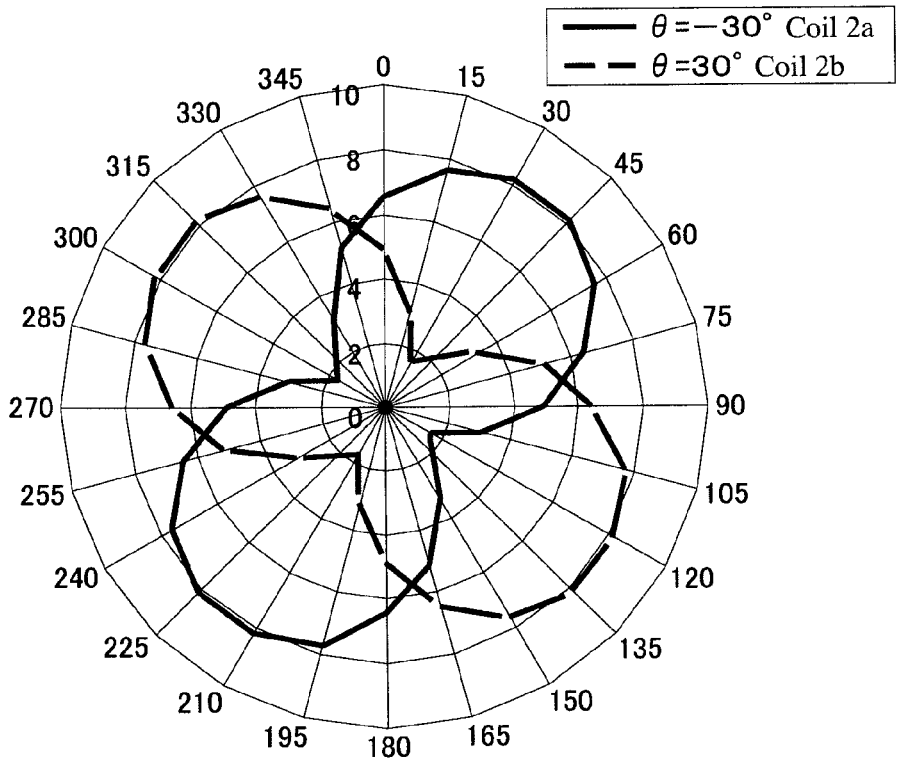
FIG. 9 is a polar graph showing the dependency of receiving sensitivity on a direction in an in an XY plane in the resonance-type, receiving antenna of Example 6.

With respect to this antenna, the detection sensitivity of a magnetic flux was measured in all directions (360°) in an XY plane whose origin was a geographical center O of the circular-ring-shaped, magnetic core 1. The results are shown in FIG. 9. The radial axis of the polar graph indicates voltage (mV) detected at both ends of the coil. As is clear from FIG. 9, the directions of two coils 2*a*, 2*b* providing the maximum detection sensitivity of a magnetic flux are perpendicular to each other, and the direction of each coil 2*a*, 2*b* providing the maximum magnetic-flux-detecting sensitivity is deviated from the axial direction by 15°. The ratio of the minimum voltage to the maximum voltage (minimum voltage/maximum voltage) was 21% (1.7/8×100) for both two coils 2*a*, 2*b*.

FIGS. 8(*b*) and 8(*c*) show modified examples of the antenna of FIG. 8(*a*). An angle between the two gaps 4*a*, 4*b* is 90° in the example of FIG. 8(*b*), the circular-ring-shaped, magnetic core 1 has three gaps 4*a*, 4*b*, 4*c* in the example of FIG. 8(*c*). These antennas have the same sensitivity as that of the antenna of FIG. 8(*a*).

Example 7

When the circular-ring-shaped, magnetic core 1 shown in FIG. 8(*a*) was deformed such that an outer diameter $R_4$ of the circular-ring-shaped, magnetic core 1 passing through a center of the gap 4 was the longest diameter Dmax, and that an outer diameter perpendicular to $R_4$ was the shortest diameter Dmin, the directivity of the antenna was examined with varied Dmax/Dmin ratios. The detected maximum voltage was 90% or more of Example 6 (FIG. 9) when the Dmax/Dmin was 2 or less, but it was drastically reduced to 80% or less of Example 6 when the Dmax/Dmin exceeded 2. Oppositely, even when the circular-ring-shaped, magnetic core 1 was deformed with $R_4$ as Dmin, and an outer diameter perpendicular to $R_4$ as Dmax, the same tendency was appreciated. The same tendency was also appreciated in the circular-ring-shaped, magnetic core 1 shown in FIGS. 8(*b*) and 8(*c*). Accordingly, the Dmax/Dmin ratio is preferably in a range of 1-2.

Example 8

FIG. 10(*a*) shows a further example of rectangular-ring-shaped, resonance-type, receiving antennas. The rectangular-ring-shaped, magnetic core 1 is constituted by an L-shaped, magnetic core piece 1*a* of 20 mm in each outer side and 1.5 mm in width, an I-shaped, magnetic core piece 1*b* of 22 mm in length and 1.5 mm in width, and an I-shaped, magnetic core piece 1*c* of 19 mm in length and 1.5 mm in width. Each magnetic core piece was produced by punching a 14-μm-thick ribbon made of the same Co-based, amorphous alloy (ACO5) as in Example 1 to obtain 10 ribbon pieces, laminating them with a 2-μm-thick epoxy resin coating on each ribbon piece, and heat-curing them. Gaps 4*a*, 4*b* were 0.5 mm, and a gap 4*c* was 1.5 mm.

Each coil 2*a*, 2*b* was produced by winding a 0.1-mm-thick magnet wire (enameled wire) by 100 turns around a core of 2 mm in width and 300 μm in thickness, and then removing the core. The coil 2*a* was mounted to the I-shaped magnetic core piece 1*b*, and the coil 2*b* was mounted to the I-shaped magnetic core piece 1*c*. The axial directions of both coils 2*a*, 2*b* were perpendicular to each other. The distance between the coil 2*a* and the gap 4*b* was the same as the distance between the coil 2*b* and the gap 4*a*. A capacitor was connected in parallel to each coil 2*a*, 2*b* to constitute a resonance circuit.

Figure 11:
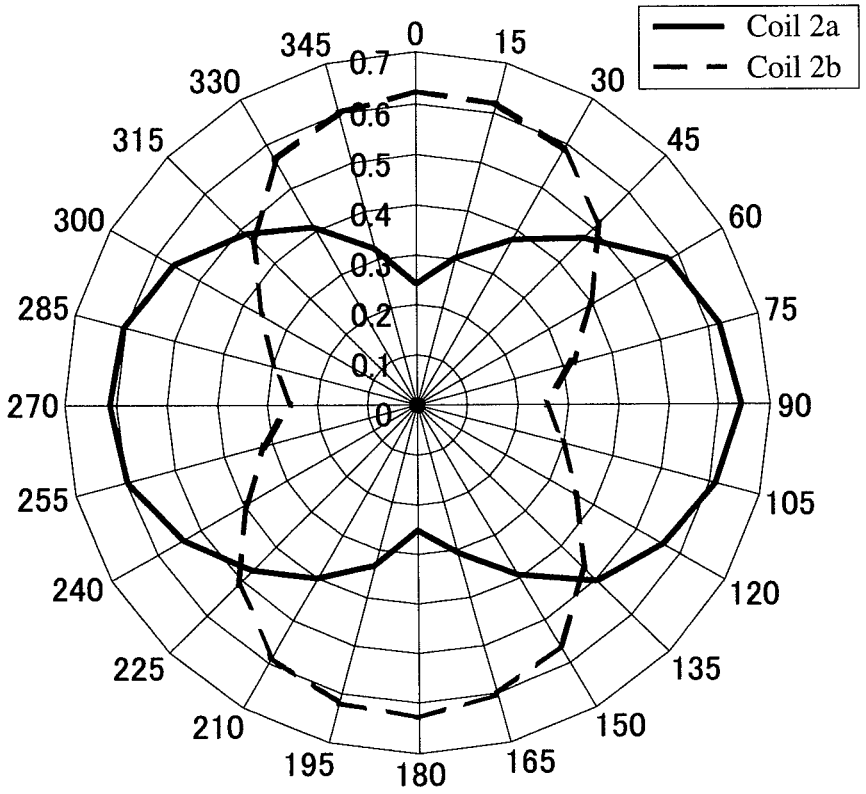
FIG. 11 is a polar graph showing the dependency of receiving sensitivity on a direction in an in an XY plane in the resonance-type, receiving antenna of Example 8.

The detection sensitivity of a magnetic flux was measured in all directions (360°) in an XY plane whose origin was the geographical center O of the rectangular-ring-shaped, magnetic core 1, in the same manner as in Example 1. The results are shown in FIG. 11. The receiving sensitivity of each coil 2*a*, 2*b* is at the maximum in directions perpendicular to the axial direction. This appears to be due to the fact that a resonance magnetic flux generated from one coil excites the other coil. The ratio of the minimum voltage to the maximum voltage (minimum voltage/maximum voltage) was about 40% (0.25/0.63×100) for both of two coils 2*a*, 2*b*.

The resonance-type, receiving antenna shown in FIG. 10(*a*) comprises three magnetic core pieces 1*a*, 1*b*, 1*c*, I-shaped magnetic core pieces 1*b*, 1*c* being provided with coils 2*a*, 2*b* perpendicular to each other. However, as shown in FIGS. 10(*b*) and 10(*c*), it may comprise two magnetic core pieces 1*a*, 1*b*, each magnetic core piece 1*a*, 1*b* being provided with each coil 2*a*, 2*b*.

Example 9

Figure 12A:
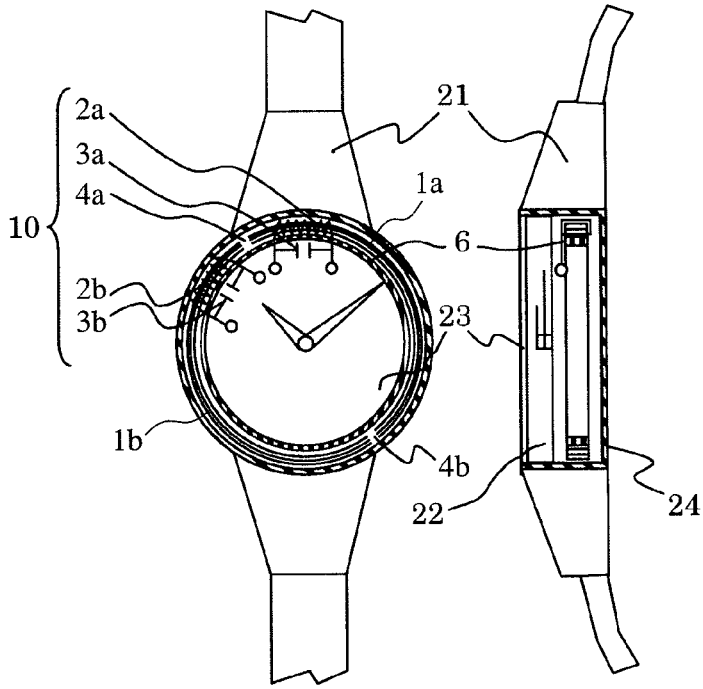
FIG. 12(*a*) is a schematic view showing one example of radiowave wristwatches comprising the resonance-type, receiving antenna of the present invention.
Figure 12B:
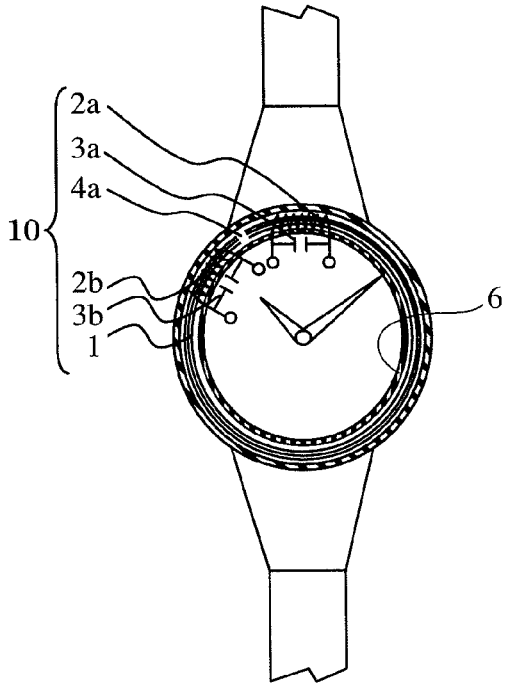

FIGS. 12(*a*) and 12(*b*) schematically show examples of radiowave wristwatches containing the receiving antenna 10 of the present invention. FIG. 12(*a*) shows a receiving antenna comprising two coils 2*a*, 2*b* disposed on a circular-ring-shaped, magnetic core 1 having two gaps 4*a*, 4*b*, and FIG. 12(*b*) shows a receiving antenna comprising two coils 2*a*, 2*b* disposed on a circular-ring-shaped, magnetic core 1 having one gap 4. In both cases, the radiowave wristwatch comprises a casing 21 made of a metal (for example, stainless steel), a movement 22, and peripheral devices, a glass lid 23, a rear lid 24 made of a metal (for example, stainless steel), and the receiving antenna 10. The receiving antenna 10 comprises a circular-ring-shaped, magnetic core 1 (comprising arcuate magnetic core pieces 1*a*, 1*b*) substantially surrounding an entire periphery of the movement 22 along an inner surface of the casing 21, two coils 2*a*, 2*b* disposed near the gap 4*a* (4) of the circular-ring-shaped, magnetic core 1, and a capacitor 3*a*, 3*b* connected to each coil 2*a*, 2*b*. The arrangement of the receiving antenna 10 in space between the casing 21 and the movement 22 prevents the wristwatch from becoming larger. Also disposed inside the circular-ring-shaped, magnetic core 1 are an additional coil 6, and a means (not shown) for measuring voltage induced by magnetic flux passing through that coil.

The conventional receiving antenna has a complicated structure comprising members such as a bobbin fixed to a circuit board, etc., and their arrangement needs time-consuming work such as complicated fixing steps, for instance, welding, etc. On the other hand, the receiving antenna of the present invention having a simple structure can be easily arranged in the casing.

The circular-ring-shaped, magnetic core 1 was produced by laminating pluralities of ribbons of a Co-based, amorphous alloy (ACO5) each having a width of 1 mm, a thickness of 18 μm and a predetermined length and a 2-μm-thick epoxy resin coating to a desired shape, and heat-curing the epoxy resin.

The receiving antenna 10 with such structure can receive magnetic flux coming from outside the casing 21 substantially in all directions in an XY plane. In addition, because the additional coil 6 for receiving magnetic flux flowing in the axial direction (Z-axis direction) of the circular-ring-shaped, magnetic core 1 is disposed inside the circular-ring-shaped, magnetic core 1, radiowaves in all directions in XYZ axes can be received in the metal casing 21.

Example 10

Figure 13A:
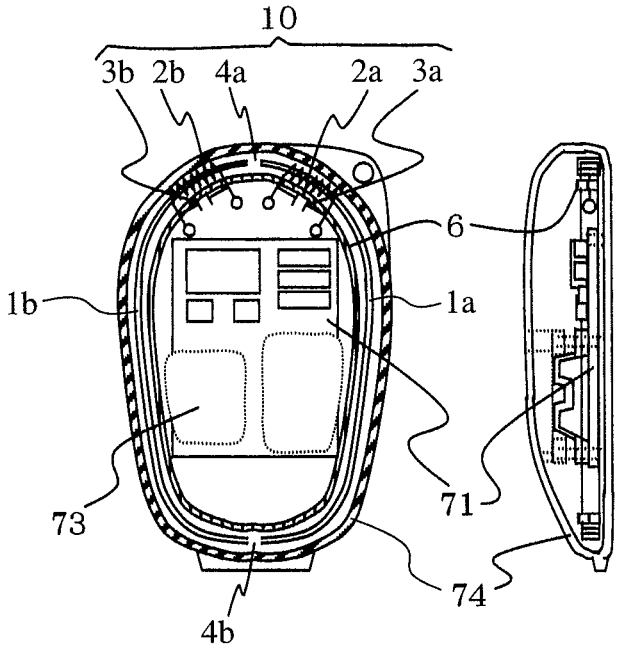
FIG. 13(*a*) is a schematic view showing one example of RFID systems comprising the resonance-type, receiving antenna of the present invention.
Figure 13B:
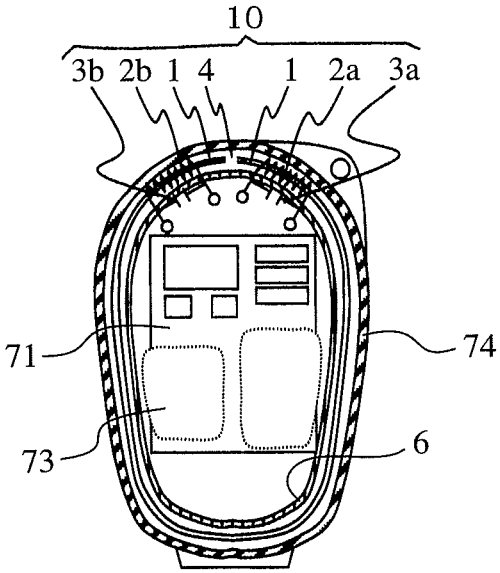
Figure 14:
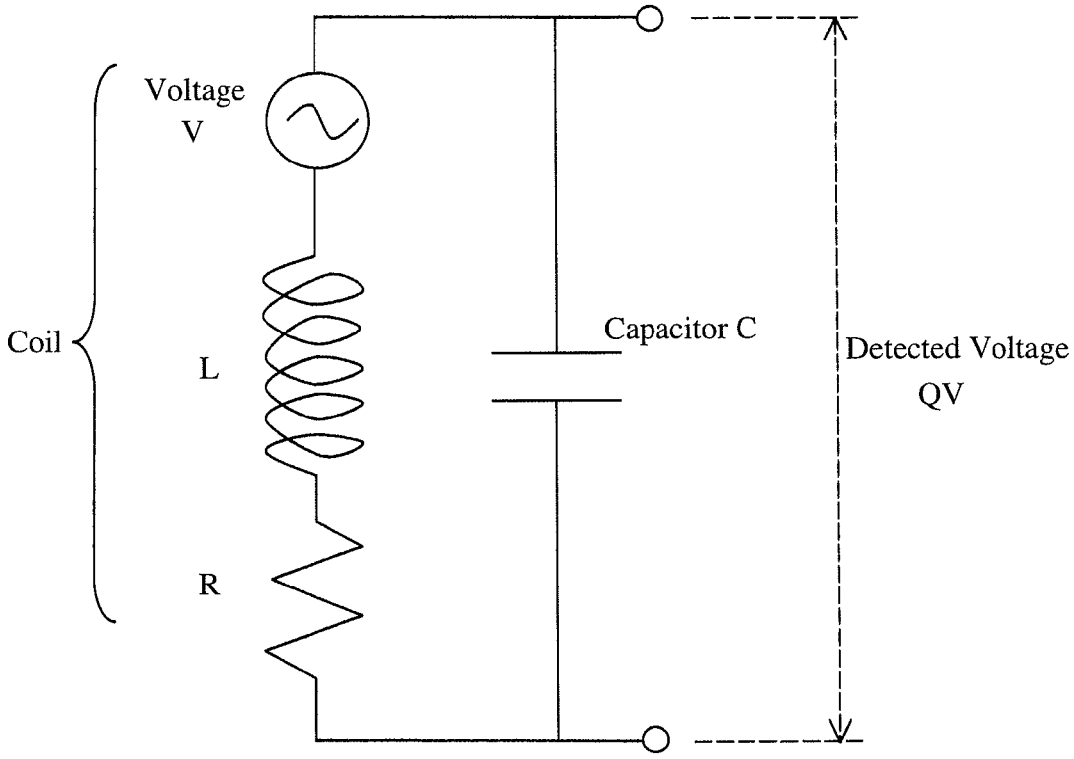
FIG. 14 is a view showing the equivalent circuit of the resonance-type, receiving antenna.

FIGS. 13(*a*) and 13(*b*) schematically show examples of key bodies for a keyless entry system, one of RFID tags containing the receiving antenna 10 of the present invention. FIG. 13(*a*) schematically shows a receiving antenna comprising two coils 2*a*, 2*b* disposed around a circular-ring-shaped, magnetic core 1 having two gaps 4*a*, 4*b*, and FIG. 13(*b*) schematically shows a receiving antenna comprising two coils 2*a*, 2*b* disposed around a circular-ring-shaped, magnetic core 1 having one gap 4.

The substantially oval-shaped key body comprises a metal casing 74, a key-opening button 73, a printed circuit board 71 having various devices, and the receiving antenna 10. The receiving antenna 10 comprises a circular-ring-shaped, magnetic core 1 along an inner surface of the casing 74, two coils 2*a*, 2*b* disposed near the gap 4*a*(4) of the circular-ring-shaped, magnetic core 1, and capacitors 3*a*, 3*b* each connected to each coil 2*a*, 2*b*. The arrangement of the receiving antenna 10 along an inner surface of the casing 74 prevents the key body from becoming larger. Also arranged inside the circular-ring-shaped, magnetic core 1 are an additional coil 6, and a means (not shown) for measuring voltage induced by a magnetic flux passing through that coil.

The circular-ring-shaped, magnetic core 1 was produced by laminating pluralities of ribbons of a Co-based, amorphous alloy (ACO5) each having a width of 1 mm, a thickness of 18 μm and a predetermined length and a 2-μm-thick epoxy resin coating to a desired shape, and heat-curing the epoxy resin.

The receiving antenna 10 with such structure can receive magnetic flux coming from outside the casing 74 substantially in all directions in an XY plane. In addition, because the additional coil 6 for receiving magnetic flux flowing in the axial direction (Z-axis direction) of the circular-ring-shaped, magnetic core 1 is disposed inside the circular-ring-shaped, magnetic core 1, radiowaves in all directions in XYZ axes can be received in the metal casing 74.

EFFECT OF THE INVENTION

The resonance-type, receiving antenna of the present invention comprising a circular- or rectangular-ring-shaped, magnetic core for forming a closed magnetic path having one gap has high detection sensitivity not only in the axial direction of the coil, but also in directions perpendicular to the axial direction.

With two coils, even one circular-ring-shaped, magnetic core provides an antenna with high detection sensitivity in all directions in an XY plane whose origin is a geographical center of the core. In the case of a rectangular-ring-shaped, magnetic core, the arrangement of two coils perpendicular to each other provides an antenna with high detection sensitivity in all directions in an XY plane.

The arrangement of circuit devices inside the circular-ring-shaped, magnetic core provides a receiving apparatus with less influence on the circuit devices by radiowaves, and with less noise even at high output voltage. The circular-ring-shaped, magnetic core made of high-strength, soft-magnetic materials such as ribbons or thin wires of soft-magnetic alloys is suitable for arrangement along an inner surface of the metal casing.

Less restricted by the shape of the casing, the resonance-type, receiving antenna of the present invention is suitable for small radiowave watches (particularly radiowave wrist-watches) having various shapes for users' preference, keyless entry systems, RFID tag systems, etc.

What is claimed is:

1. A resonance-type, receiving antenna comprising:

a circular-ring-shaped, magnetic core constituting a closed magnetic path having a single gap in the circular-ring-shaped magnetic core, a coil wound around said circular-ring-shaped, magnetic core, and a capacitor connected in parallel to both ends of said coil;

an angle between a straight line extending from a geographical center of said circular-ring-shaped, magnetic core to a center of said gap and a straight line extending from said geographical center to a center of said coil being in a range of 10° to 90°.

2. The resonance-type, receiving antenna according to claim 1, wherein said circular-ring-shaped, magnetic core has a ratio of the longest diameter to the shortest diameter in a range of 1-2.

3. The resonance-type, receiving antenna according to claim 1, wherein said magnetic core is obtained by laminating ribbons of a soft-magnetic, amorphous or nano-crystalline alloy, or by bundling thin wires of a soft-magnetic, amorphous or nano-crystalline alloy.

4. A receiving apparatus comprising the resonance-type, receiving antenna recited in claim 1, wherein circuit devices are disposed inside said resonance-type, receiving antenna.

5. A resonance-type, receiving antenna comprising:

a circular-ring-shaped, magnetic core constituting a closed magnetic path having a single gap in the circular-ring-shaped magnetic core, two coils wound around said circular-ring-shaped, magnetic core, and a capacitor connected in parallel to both ends of each coil;

an angle between a straight line extending from a geographical center of said circular-ring-shaped, magnetic core to a center of said gap and a straight line extending from said geographical center to a center of each coil being in a range of 10° to 90°.

6. The resonance-type, receiving antenna according to claim 5, wherein said circular-ring-shaped, magnetic core has a ratio of the longest diameter to the shortest diameter in a range of 1-2.

7. The resonance-type, receiving antenna according to claim 5, wherein said magnetic core is obtained by laminating ribbons of a soft-magnetic, amorphous or nano-crystalline alloy, or by bundling thin wires of a soft-magnetic, amorphous or nano-crystalline alloy.

8. A receiving apparatus comprising the resonance-type, receiving antenna recited in claim 5, wherein circuit devices are disposed inside said resonance-type, receiving antenna.

9. A resonance-type, receiving antenna comprising a rectangular-ring-shaped, magnetic core constituting a closed magnetic path having one gap, two coils wound around said rectangular-ring-shaped, magnetic core, and a capacitor connected in parallel to both ends of each coil;

the axial directions of said two coils being perpendicular to each other; and the distances between said coils and said gap being different.

10. The resonance-type, receiving antenna according to claim 9, wherein said magnetic core is obtained by laminating ribbons of a soft-magnetic, amorphous or nano-crystalline alloy, or by bundling thin wires of a soft-magnetic, amorphous or nano-crystalline alloy.

11. A receiving apparatus comprising the resonance-type, receiving antenna recited in claim 9, wherein circuit devices are disposed inside said resonance-type, receiving antenna.

12. A resonance-type, receiving antenna comprising:

a circular-ring-shaped magnetic core constituting a closed magnetic path having two or three gaps and segments disposed therebetween;

two coils wound around said circular-ring-shaped magnetic core; and a capacitor connected in parallel to both ends of each respective coil;

wherein the two coils are wound around adjacent segments of the circular-ring-shaped magnetic core so that a respective angle between a straight line extending from a geographical center of said circular-ring-shaped magnetic core to a center of one gap disposed between the adjacent segments and a straight line extending from said geographical center to a center of each respective coil is in a range of 10° to 90°.

13. The resonance-type, receiving antenna according to claim 12, wherein said magnetic core is obtained by laminating ribbons of a soft-magnetic, amorphous or nano-crystalline alloy, or by bundling thin wires of a soft-magnetic, amorphous or nano-crystalline alloy.

14. A receiving apparatus comprising the resonance-type, receiving antenna recited in claim 12, wherein circuit devices are disposed inside said resonance-type, receiving antenna.

15. A resonance-type, receiving antenna comprising:

a rectangular-ring-shaped magnetic core comprising a closed magnetic path having segments and two or three gaps disposed therebetween;

two coils wound around the segments of said rectangular-ring-shaped magnetic core disposed perpendicular to each other; and a capacitor connected in parallel to both ends of each respective coil, wherein the axial directions of said two coils are perpendicular to each other.

16. The resonance-type, receiving antenna according to claim 15, wherein said magnetic core is obtained by laminating ribbons of a soft-magnetic, amorphous or nano-crystalline alloy, or by bundling thin wires of a soft-magnetic, amorphous or nano-crystalline alloy.

17. A receiving apparatus comprising the resonance-type, receiving antenna recited in claim 15, wherein circuit devices are disposed inside said resonance-type, receiving antenna.

* * * * *